US012680041B2

(12) United States Patent
Wang

(10) Patent No.: US 12,680,041 B2
(45) Date of Patent: Jul. 14, 2026

(54) MULTI-FUNCTIONAL FUEL ADDITIVE TO PROVIDE FRICTION REDUCTION AND CORROSION PROTECTION

(71) Applicant: Afton Chemical Corporation, Richmond, VA (US)

(72) Inventor: Janice Jianzhao Wang, Glen Allen, VA (US)

(73) Assignee: Afton Chemical Corporation

( * ) Notice: Subject to any disclaimer, the term of this patent is extended or adjusted under 35 U.S.C. 154(b) by 0 days.

(21) Appl. No.: 18/619,639

(22) Filed: Mar. 28, 2024

(65) Prior Publication Data

US 2025/0304871 A1 Oct. 2, 2025

(51) Int. Cl.

| | |
|---|---|
| ***C10L 10/08*** | (2006.01) |
| ***C10L 1/189*** | (2006.01) |
| ***C10L 1/222*** | (2006.01) |
| ***C10L 1/232*** | (2006.01) |
| ***C10L 10/04*** | (2006.01) |

(52) U.S. Cl.

CPC ..... *C10L 1/1895* (2013.01); *C10L 1/2222* (2013.01); *C10L 1/232* (2013.01); *C10L 10/04* (2013.01); *C10L 10/08* (2013.01); *C10L 2270/023* (2013.01); *C10L 2270/026* (2013.01)

(58) Field of Classification Search

CPC ..... C10L 1/1895; C10L 1/2222; C10L 1/232; C10L 10/04; C10L 10/08; C10L 2270/023; C10L 2270/026

See application file for complete search history.

(56) References Cited

U.S. PATENT DOCUMENTS

| | | | |
|---|---|---|---|
| 2,425,755 | A | 8/1947 | Roberts et al. |
| 2,425,845 | A | 8/1947 | Toussaint et al. |
| 2,448,664 | A | 9/1948 | Fife et al. |
| 2,457,139 | A | 12/1948 | Fife et al. |
| 2,475,755 | A | 7/1949 | Pearson |
| 2,568,876 | A | 9/1951 | White et al. |
| 2,886,423 | A | 5/1959 | Kozikowski |
| 3,015,668 | A | 1/1962 | Kozikowski |
| 3,018,250 | A | 1/1962 | Anderson et al. |
| 3,027,246 | A | 3/1962 | Bartlett |
| 3,092,474 | A | 6/1963 | Ebner |
| 3,172,892 | A | 3/1965 | Suer et al. |
| 3,198,613 | A | 8/1965 | Udelhofen |
| 3,202,678 | A | 8/1965 | Stuart et al. |
| 3,216,936 | A | 11/1965 | Suer et al. |
| 3,219,666 | A | 11/1965 | Norman et al. |
| 3,254,025 | A | 5/1966 | Suer |
| 3,272,746 | A | 9/1966 | Suer et al. |
| 3,361,673 | A | 1/1968 | Stuart et al. |
| 3,468,640 | A | 9/1969 | Barusch et al. |
| 3,676,089 | A | 7/1972 | Morris et al. |
| 3,778,371 | A | 12/1973 | Malec |
| 4,038,043 | A | 7/1977 | Garth |
| 4,056,531 | A | 11/1977 | Malec |
| 4,067,698 | A | 1/1978 | Steckel |
| 4,152,499 | A | 5/1979 | Boerzel et al. |
| 4,171,959 | A | 10/1979 | Vartanian |
| 4,231,759 | A | 11/1980 | Udelhofen et al. |
| 4,234,435 | A | 11/1980 | Meinhardt et al. |
| 4,248,719 | A | 2/1981 | Chafetz et al. |
| 4,253,980 | A | 3/1981 | Hammond et al. |
| 4,326,973 | A | 4/1982 | Hammond et al. |
| 4,338,206 | A | 7/1982 | Hammond et al. |
| 4,482,357 | A | 11/1984 | Hanlon |
| 4,605,808 | A | 8/1986 | Samson et al. |
| 4,613,341 | A | 9/1986 | Zaweski et al. |
| 4,729,769 | A | 3/1988 | Schlicht et al. |
| 4,787,916 | A | 11/1988 | Feldman |
| 4,844,714 | A | 7/1989 | Vogel et al. |
| 4,877,416 | A | 10/1989 | Campbell et al. |
| 5,024,677 | A | 6/1991 | Wang |
| 5,250,174 | A | 10/1993 | Hart |
| 5,254,138 | A | 10/1993 | Kurek |
| 5,266,223 | A | 11/1993 | Song et al. |
| 5,330,667 | A | 7/1994 | Tiffany, III |
| 5,393,309 | A | 2/1995 | Cherpeck |
| 5,514,190 | A | 5/1996 | Cunningham et al. |
| 5,518,511 | A | 5/1996 | Russel et al. |
| 5,575,823 | A | 11/1996 | Wallace et al. |
| 5,620,486 | A | 4/1997 | Cherpeck |
| 5,634,951 | A | 6/1997 | Colucci et al. |
| 5,697,988 | A | 12/1997 | Malfer et al. |
| 5,725,612 | A | 3/1998 | Malfer et al. |

(Continued)

FOREIGN PATENT DOCUMENTS

| | | | |
|---|---|---|---|
| CA | 2089833 | A1 | 8/1993 |
| CN | 1256302 | A | 6/2000 |

(Continued)

OTHER PUBLICATIONS

Yau et al., "Modern Size Exclusion Liquid Chromatography", John Wiley and Sons, New York, 1979.

Smith, S. Scott et al. Measurement and Control of Fuel Injector Deposits in Direct Injection Gasoline Vehicles, SAE International; Oct. 14, 2013. doi: 10.4271/2013-01-2616.

The extended European Search Report issued in Application No. 23195793.7 dated Jan. 30, 2024, 7 pages.

(Continued)

*Primary Examiner* — Ellen M McAvoy

*Assistant Examiner* — Chantel Graham

(74) *Attorney, Agent, or Firm* — Honigman LLP

(57) ABSTRACT

The present disclosure provides fuel additives including detergent additives, optional alkoxylated alcohol additives, and a multi-functional additive including a saturated or an unsaturated cyclic moiety-containing dicarboxylic acid.

19 Claims, No Drawings

(56) References Cited

U.S. PATENT DOCUMENTS

| | | | |
|---|---|---|---|
| 5,743,922 | A | 4/1998 | Peter-Hoblyn et al. |
| 5,752,989 | A | 5/1998 | Henly et al. |
| 5,756,428 | A | 5/1998 | Emert et al. |
| 5,800,103 | A | 9/1998 | Malfer et al. |
| 5,814,111 | A | 9/1998 | Graham et al. |
| 5,873,917 | A | 2/1999 | Daly |
| 5,876,468 | A | 3/1999 | Moreton |
| 6,048,373 | A | 4/2000 | Malfer et al. |
| 6,166,238 | A | 12/2000 | Filipkowski et al. |
| 6,405,711 | B1 | 6/2002 | Smith et al. |
| 6,458,172 | B1 | 10/2002 | Macduff et al. |
| 6,462,014 | B1 | 10/2002 | Johnson |
| 6,475,250 | B2 | 11/2002 | Krull et al. |
| 6,548,458 | B2 | 4/2003 | Loper |
| 6,695,890 | B1 | 2/2004 | Hazel et al. |
| 6,730,773 | B2 | 5/2004 | Heinen |
| 6,800,103 | B2 | 10/2004 | Malfer et al. |
| 6,867,171 | B2 | 3/2005 | Harrison et al. |
| 7,297,675 | B2 | 11/2007 | Alef |
| 7,402,185 | B2 | 7/2008 | Aradi et al. |
| 7,435,272 | B2 | 10/2008 | Aradi et al. |
| 7,704,289 | B2 | 4/2010 | Alters et al. |
| 7,744,660 | B2 | 6/2010 | Burrington et al. |
| 7,766,982 | B2 | 8/2010 | Colucci et al. |
| 7,906,470 | B2 | 3/2011 | Stevenson et al. |
| 7,947,093 | B2 | 5/2011 | Barton et al. |
| 7,951,211 | B2 | 5/2011 | Barton et al. |
| 8,097,570 | B2 | 1/2012 | Boutout et al. |
| 8,231,695 | B2 | 7/2012 | Cunningham et al. |
| 8,425,627 | B2 | 4/2013 | Dietz et al. |
| 8,449,630 | B2 | 5/2013 | Lange et al. |
| 8,475,541 | B2 | 7/2013 | Fang et al. |
| 8,486,876 | B2 | 7/2013 | Brewer et al. |
| 8,496,716 | B2 | 7/2013 | Lange et al. |
| 8,557,003 | B2 | 10/2013 | Malfer et al. |
| 8,778,034 | B2 | 7/2014 | Cunningham |
| 8,863,700 | B2 | 10/2014 | Fang et al. |
| 8,894,726 | B2 | 11/2014 | Fang et al. |
| 8,961,623 | B2 | 2/2015 | Stevenson et al. |
| 8,974,551 | B1 | 3/2015 | Fang et al. |
| 9,062,265 | B2 | 6/2015 | Reid et al. |
| 9,340,742 | B1 | 5/2016 | Fang et al. |
| 9,464,252 | B2 | 10/2016 | Schwab et al. |
| 2003/0014910 | A1 | 1/2003 | Aradi et al. |
| 2003/0131527 | A1 | 7/2003 | Colucci et al. |
| 2004/0029766 | A1 | 2/2004 | Frick et al. |
| 2004/0060226 | A1 | 4/2004 | Bongart et al. |
| 2004/0167040 | A1 | 8/2004 | Dahlmann et al. |
| 2005/0066572 | A1 | 3/2005 | Colucci et al. |
| 2005/0120619 | A1 | 6/2005 | Koch et al. |
| 2005/0215411 | A1 | 9/2005 | Mackney et al. |
| 2006/0070293 | A1 | 4/2006 | Lange et al. |
| 2006/0168876 | A1 | 8/2006 | Colucci et al. |
| 2006/0196110 | A1 | 9/2006 | Schwahn et al. |
| 2006/0196111 | A1 | 9/2006 | Colucci et al. |
| 2006/0272597 | A1 | 12/2006 | Burrington et al. |
| 2007/0015681 | A1 | 1/2007 | Allef et al. |
| 2007/0193119 | A1 | 8/2007 | Hoffman |
| 2007/0245621 | A1 | 10/2007 | Malfter et al. |
| 2008/0086936 | A1 | 4/2008 | Cunningham et al. |
| 2008/0113890 | A1 | 5/2008 | Moreton et al. |
| 2008/0307698 | A1 | 12/2008 | Barton et al. |
| 2009/0049740 | A1 | 2/2009 | Hurst |
| 2009/0235576 | A1 | 9/2009 | Volkel et al. |
| 2009/0282731 | A1 | 11/2009 | Malfer et al. |
| 2010/0005706 | A1 | 1/2010 | Burgazli et al. |
| 2010/0024289 | A1 | 2/2010 | Smith et al. |
| 2010/0037513 | A1 | 2/2010 | Petrucci et al. |
| 2010/0037514 | A1 | 2/2010 | Malfer et al. |
| 2010/0132253 | A1 | 6/2010 | Kaufman et al. |
| 2010/0151396 | A1 | 6/2010 | Papachristos et al. |
| 2010/0236510 | A1 | 9/2010 | Shea et al. |
| 2011/0162263 | A1 | 7/2011 | Vilardo et al. |
| 2011/0185626 | A1 | 8/2011 | Barton et al. |
| 2011/0237469 | A1 | 9/2011 | Khandekar et al. |
| 2011/0258917 | A1 | 10/2011 | Garcia Castro et al. |
| 2011/0302828 | A1 | 12/2011 | Fang et al. |
| 2011/0308550 | A1 | 12/2011 | Reid |
| 2011/0315107 | A1 | 12/2011 | Grabarse et al. |
| 2012/0010112 | A1 | 1/2012 | Grabarse et al. |
| 2012/0291339 | A1 | 11/2012 | Martin et al. |
| 2013/0031827 | A1 | 2/2013 | Reid et al. |
| 2013/0031828 | A1 | 2/2013 | Reid et al. |
| 2013/0104826 | A1 | 5/2013 | Burgess et al. |
| 2013/0220255 | A1 | 8/2013 | Fang |
| 2013/0227878 | A1 | 9/2013 | Wolf et al. |
| 2013/0233267 | A1 | 9/2013 | Barbour |
| 2013/0237466 | A1 | 9/2013 | Lange et al. |
| 2013/0247450 | A1 | 9/2013 | Wolf |
| 2013/0255139 | A1 | 10/2013 | Dolmazon et al. |
| 2013/0296210 | A1 | 11/2013 | Hansch et al. |
| 2013/0298948 | A1 | 11/2013 | Company et al. |
| 2013/0312318 | A1 | 11/2013 | Peretolchin et al. |
| 2013/0324665 | A1 | 12/2013 | Shaikh et al. |
| 2013/0333650 | A1 | 12/2013 | Fang et al. |
| 2014/0157655 | A1 | 6/2014 | Tort et al. |
| 2014/0174390 | A1 | 6/2014 | Reid et al. |
| 2015/0033617 | A1 | 2/2015 | Arondel et al. |
| 2015/0252277 | A1 | 9/2015 | Hansch et al. |
| 2016/0272912 | A1 | 9/2016 | Voelkel et al. |
| 2016/0289584 | A1* | 10/2016 | Russo ..... C10L 10/08 |
| 2020/0283691 | A1* | 9/2020 | Raj Mohan ..... C10L 1/221 |
| 2023/0077913 | A1* | 3/2023 | Schwab ..... C10L 1/221 44/415 |
| 2023/0365880 | A1 | 11/2023 | Zhao |
| 2024/0132792 | A1* | 4/2024 | Brennan ..... C10L 1/1852 |

FOREIGN PATENT DOCUMENTS

| | | | |
|---|---|---|---|
| CN | 101671584 | B | 3/2010 |
| EP | 0016312 | A1 | 10/1980 |
| EP | 0293192 | A1 | 11/1988 |
| EP | 0565285 | A1 | 10/1993 |
| EP | 1293553 | A2 | 3/2003 |
| EP | 1344785 | A1 | 9/2003 |
| EP | 1411105 | A2 | 4/2004 |
| EP | 1518918 | A1 | 3/2005 |
| EP | 1918355 | A1 | 5/2008 |
| EP | 2033945 | A1 | 3/2009 |
| EP | 2674471 | A1 | 12/2013 |
| EP | 2987845 | A1 | 2/2016 |
| EP | 3597726 | A1 | 1/2020 |
| GB | 842728 | A1 | 7/1960 |
| GB | 949981 | A | 2/1964 |
| GB | 1439899 | A | 6/1976 |
| GB | 2493377 | A | 2/2013 |
| WO | 2004050806 | A2 | 6/2004 |
| WO | 2005023965 | A1 | 3/2005 |
| WO | 2006135881 | A2 | 12/2006 |
| WO | 2007015080 | A1 | 2/2007 |
| WO | 2010132209 | A1 | 11/2010 |
| WO | 2013000738 | A2 | 1/2013 |
| WO | 2013017889 | A1 | 2/2013 |
| WO | 2013070503 | A1 | 5/2013 |
| WO | 2013092533 | A1 | 6/2013 |
| WO | 2015011505 | A1 | 1/2015 |
| WO | 2017168312 | A1 | 10/2017 |
| WO | 2019079246 | A1 | 4/2019 |

OTHER PUBLICATIONS

Extended European Search Report for EP 25162056.3, dated Sep. 17, 2025.

* cited by examiner

MULTI-FUNCTIONAL FUEL ADDITIVE TO PROVIDE FRICTION REDUCTION AND CORROSION PROTECTION

TECHNICAL FIELD

This disclosure is directed to fuel additives providing enhanced performance, to fuel compositions including such additives, and to methods of using such fuel additives in a fuel composition for at least improved friction and/or corrosion performance.

BACKGROUND

Fuel compositions for vehicles are continually being improved to enhance various properties of the fuels in order to accommodate their use in newer, more advanced engines including both gasoline engines and diesel engines. Often, improvements in fuel compositions center around improved fuel additives and other components used in the fuel. For example, friction modifiers may be added to fuel to reduce friction and wear in the fuel delivery systems of an engine. Other additives may be included to reduce the corrosion potential of the fuel or to improve the conductivity properties. Still other additives may be blended with the fuel to improve fuel economy. Thus, fuel compositions typically include a complex mixture of multiple additives.

However, there remain challenges when attempting to balance such a complex assortment of additives. For example, some of the conventional fuel additives may be beneficial for one characteristic or one type of engine, but at the same time be detrimental to another characteristic of the fuel or different engine type. In modern engines, friction between piston and cylinder walls, within the valve train, and/or within the fuel pump are often factors resulting in increasing fuel consumption. Additionally, durability of fuel pumps and injectors also require sufficient lubricity often addressed via one or more additional lubricity additives and/or friction modifiers. Improving fuel economy and extending the normal working life of engine and associated fuel delivery parts has become more and more important for manufacturing in the automotive and petroleum industry. As such, the incorporation of friction modifiers can reduce friction and prevent engine wear; therefore, aiding to improve acceleration, power and fuel economy. Corrosion inhibitors may also be added in fuel additive package to control/prevent corrosion in storage tanks, facilities, pipelines, and vehicles.

However, with the ever challenging requirements of so many competing performance results, there tends to be limits on the number of distinct compositional additives that can be included in fuels. In many circumstances, for instance, varying one component or adding additional components within a fuel additive composition to improve performance characteristics tends to negatively impact one or more other performance characteristics. Thus, it becomes difficult to balance all the competing performance requirements with limited fuel additive componentry.

SUMMARY

In one embodiment or approach, a fuel additive package is described herein. In one aspect, the fuel additive package includes a detergent selected from one or more of a Mannich detergent, a succinimide detergent, a polyisobutylene amine detergent, a polyetheramine detergent, a quaternary ammonium salt detergent, or combinations thereof; optionally, an alkoxylated alcohol; and a multi-functional additive comprising a cyclic moiety-containing dicarboxylic acid.

In another embodiment or approach, the fuel additive package of the previous paragraph may include other features or embodiments in any combination. These other features or embodiments may include one or more of the following: wherein the cyclic moiety-containing dicarboxylic acid is a compound having the structure of Formula I:

(Formula I)

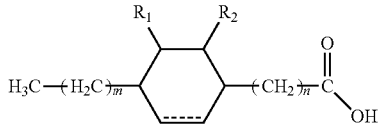

wherein one of $R_1$ and $R_2$ of Formula I is hydrogen and the other of $R_1$ and $R_2$ is —COOH; m and n are, independently, integers from 1 to 11 and where the sum of m+n is 10 to 20; and wherein the dashed line represents an optional double bond; and/or wherein m and n are each, independently, integers from 5 to 9 and the sum of m+n is 10 to 14; and/or wherein the fuel additive package includes about 1 to about 20 weight percent of the cyclic moiety-containing dicarboxylic acid; and/or wherein the fuel additive package further includes about 20 to about 70 weight percent of the detergent; and/or wherein the detergent includes one or more Mannich detergent additives have the structure of Formula II:

(Formula II)

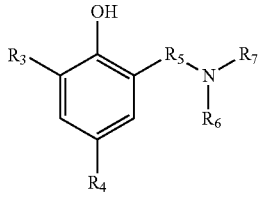

wherein $R_3$ of Formula II is hydrogen or a C1 to C4 alkyl group, $R_4$ of Formula II is a hydrocarbyl group having a molecular weight of about 500 to about 3000, $R_5$ of Formula II is a C1 to C4 alkylene or alkenyl group, and $R_6$ and $R_7$ of Formula II are, independently, hydrogen, a C1 to C12 alkyl group, or a C1 to C4 alkyl amino di(C1-C12 alkyl) group; and/or wherein the detergent includes two Mannich detergent additives, wherein the first Mannich detergent additive has the structure of Formula II with $R_6$ and $R_7$ each being the C1 to C12 alkyl group and the second Mannich detergent additive has the structure of Formula II with $R_6$ being hydrogen and $R_7$ being the di(C1 to C4)alkyl amino C1-C12 alkyl group; and/or further comprising a succinimide detergent prepared by reacting a hydrocarbyl-substituted succinic acylating agent with an amine, polyamine, or alkyl amine having one or more primary, secondary, or tertiary amino groups; and/or comprising about 5 to about 30 weight percent of the alkoxylated alcohol; and/or wherein the alkoxylated alcohol is a polyether prepared by reacting an alkyl alcohol or an alkylphenol with an alkylene oxide selected from ethylene oxide, propylene oxide, butylene oxide, copolymers thereof, or combinations thereof; and/or wherein the alkoxylated alcohol is a polyether having the structure of Formula III:

(Formula III)

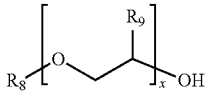

wherein $R_8$ of Formula III is an aryl group or a linear, branched, or cyclic aliphatic group having 5 to 50 carbons, $R_9$ of Formula III is a C1 to C4 alkyl group, and x is an integer from 5 to 100; and/or further comprising about 1 to about 20 weight percent of a lubricity additive; and/or further comprising a lubricity additive and wherein the lubricity additive is selected from an ammonia succinimide prepared by reacting a hydrocarbyl-substituted succinic anhydride with ammonia, a linear or branched monocarboxylic acid or salt thereof, or mixtures thereof.

In another embodiment or approach, a fuel composition is described herein including any embodiment of the fuel additive package as described in the previous two paragraphs. In other aspects, the fuel composition includes a major amount of a diesel fuel or a gasoline fuel; about 15 to about 300 ppmw of a detergent selected from one or more of a Mannich detergent, a succinimide detergent, a polyisobutylene amine detergent, a polyetheramine detergent, a quaternary ammonium salt detergent, or combinations thereof; about 0 to about 150 ppmw of an alkoxylated alcohol; and about 5 to about 250 ppmw of a multifunctional additive provided by a cyclic moiety-containing dicarboxylic acid.

In yet other embodiments or approaches, the fuel composition of the previous paragraph may include other features or embodiments in any combination. Those other features or embodiments may include one or more of the following: wherein the cyclic moiety-containing dicarboxylic acid is a compound having the structure of Formula I:

(Formula I)

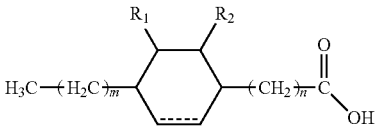

wherein one of $R_1$ and $R_2$ of Formula I is hydrogen and the other of $R_1$ and $R_2$ is —COOH; and m and n are, independently, integers from 1 to 11 and where the sum of m+n is 10 to 20; and wherein the dashed line represents an optional double bond.

In yet further embodiments or approaches, a method of reducing wear and corrosion in a combustion engine is provided herein. In one aspect, the method includes operating the combustion engine on a fuel composition containing a major amount of a fuel and a minor amount of the fuel additive package as described in any embodiment or approach of this Summary; and wherein the fuel additive package in the fuel exhibits a friction coefficient of about 0.4 or less, and/or a mean scar of about 550 μm or less pursuant to ASTM D6079, and exhibits about 10% or less rust when measured pursuant to ASTM D665A, ASTM D66B, or NACE TM-0172-2001.

In yet further embodiments or approaches, the method of the previous paragraph may include one or more other features, method steps, or embodiments in any combination. These other features, method steps, or embodiments include one or more of the following: wherein the fuel is gasoline or diesel; and/or wherein the fuel includes about 5 to about 300 ppmw of the detergent selected from one or more of a Mannich detergent, a succinimide detergent, a polyisobutylene amine detergent, a polyetheramine detergent, a quaternary ammonium salt detergent, or combinations thereof; about 0 to about 150 ppmw of the alkoxylated alcohol; and about 5 to about 250 ppmw of the unsaturated cyclic moiety-containing dicarboxylic acid; and/or wherein the cyclic moiety-containing frictio is a compound having the structure of Formula I:

(Formula I)

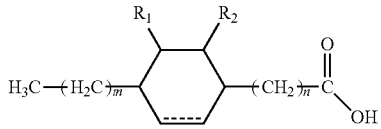

wherein one of $R_1$ and $R_2$ of Formula I is hydrogen and the other of $R_1$ and $R_2$ is —COOH; and m and n are, independently, integers from 1 to 11 and where the sum of m+n is 10 to 20; and wherein the dashed line represents an optional double bond; and/or wherein the detergent includes a Mannich detergent and a succinimide detergent.

In yet further embodiments or approaches, the present disclosure provides for the use of any embodiment of the fuel additive of this Summary, the fuel compositions of this this Summary and/or a cyclic moiety-containing dicarboxylic acid having the structure of Formula I:

(Formula I)

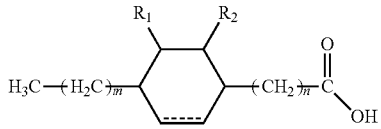

wherein one of $R_1$ and $R_2$ of Formula I is hydrogen and the other of $R_1$ and $R_2$ is —COOH; and m and n are, independently, integers from 1 to 11 and where the sum of m+n is 10 to 20; and wherein the dashed line represents an optional double bond and for reducing wear and corrosion in a combustion engine. In one aspect, the use includes operating the combustion engine on a fuel composition containing a major amount of a fuel and a minor amount of the fuel additive package as described in any embodiment or approach of this Summary; and wherein the fuel additive package and/or the compound of Formula I in the fuel exhibits a friction coefficient of about 0.4 or less, and/or a mean scar of about 550 μm or less pursuant to ASTM D6079, and exhibits about 10% or less rust when measured pursuant to ASTM D665A, ASTM D66B, or NACE TM-0172-2001.

DETAILED DESCRIPTION

The present disclosure provides fuel additives and fuels including such additives comprising at least a detergent, an optional alkoxylated alcohol (often used in gasoline fuel), and a multi-functional fuel additive configured as a friction modifier and corrosion inhibitor in a single additive compound. The multi-functional fuel additive is suitable for either gasoline or diesel fuel compositions. In one approach, the multi-functional additive includes a saturated or an unsaturated cyclic moiety-containing dicarboxylic acid, and in other approaches, is an alkylcycloalkene dicarboxylic acid wherein the cycloalkene is a C3 to C8 unsaturated cyclic group, preferably a C4 to C6 unsaturated cyclic group, and more preferably with one or two double bonds but without aromatic character. One carboxylic group may be bonded to an alkyl group and the other carboxylic group may be bonded to the cyclic group. The fuel additive may also include a detergent additive. While the detergent is not particularly limited, the detergent additive may be selected from one or more of Mannich detergents, one or more succinimide detergents, one or more polyisobutylene amine detergents, one or more polyetheramine detergents, one or more quaternary ammonium salt detergents, or various combinations thereof. In the context of a gasoline fuel, the fuel additive may further include an alkoxylated alcohol, which may be a polyether prepared by reacting an alkyl alcohol or an alkylphenol with an alkylene oxide selected from ethylene oxide, propylene oxide, butylene oxide, copolymers thereof, or combinations thereof. Each of the components in the fuel additives and fuels of this disclosure will be discussed further herein.

Cyclic Moiety-Containing Dicarboxylic Acid

In one aspect, fuel additives and fuels herein include a multi-functional additive in the form of a saturated or an unsaturated cyclic moiety-containing dicarboxylic acid. This single compound is capable of providing both friction modification and corrosion inhibition as shown in the Examples below. In one embodiment, the cyclic moiety-containing dicarboxylic acid is an alkylcycloalkene dicarboxylic acid wherein the cycloalkene moiety includes a C3 to C8 unsaturated cyclic group, preferably a C4 to C6 unsaturated cyclic group, and more preferably with one or two double bonds but without aromatic character. One carboxylic group of this compound may be bonded to an alkyl chain and the other carboxylic group may be bonded to the cyclic group.

In other embodiments, the cyclic moiety-containing dicarboxylic acid of the fuel additives and fuels herein is a compound having the structure of Formula I (Formula I)

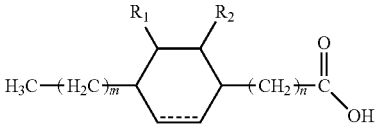

wherein one of $R_1$ and $R_2$ of Formula I is hydrogen and the other of $R_1$ and $R_2$ is —COOH and m and n of Formula I are, independently, integers from 1 to 11 (in other approaches, 5 to 9 or in yet further approaches 5 to 7) and where the sum of integers m+n is 10 to 20 (in other approaches, the sum ranges from 10 to 14 or, in yet further approaches, the sum is preferably 12). The dashed line in the cyclic moiety of Formula I represents an optional double bond. In one embodiment, the additive is 5-(7-carboxyheptyl)-2-hexylcyclodex-3-ene-1-carboxylic acid. In another embodiment, the additive has a structure:

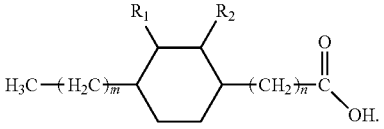

In still another embodiment, the additive has a structure:

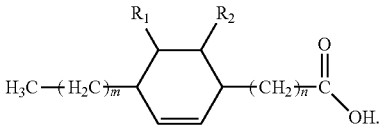

Such additive may be prepared from, for example, acrylic acid and linoleic acid as described in U.S. Pat. No. 3,753,968 or U.S. Pat. No. 4,614,600, which are both incorporated herein by reference. Other compounds of Formula I can be prepared in a similar fashion using suitable carboxylic acids.

In approaches, a fuel additive package includes about 1 to about 20 weight percent of the saturated or unsaturated cyclic moiety-containing dicarboxylic acid as described herein (in other approaches, about 5 to about 20 weight percent, or in yet other approaches, about 8 to about 15 weight percent). In a fuel composition, the fuels of this disclosure (e.g., gasoline or diesel) include about 5 to about 250 ppmw of the saturated or unsaturated cyclic moiety-containing dicarboxylic acid as described herein (in other approaches, about 20 to about 200 ppmw, or about 40 to about 150 ppmw). In yet other approaches, a gasoline fuel composition may include about 5 to about 120 ppmw (or about 20 to about 120 ppmw) of the saturated or unsaturated cyclic moiety-containing dicarboxylic acid as described herein, and in further approaches, a diesel fuel composition may include about 100 to about 250 ppmw (or about 100 to about 200 ppmw) of the saturated or unsaturated cyclic moiety-containing dicarboxylic acid as described herein.

As shown by the Examples below, a gasoline fuel composition including such amounts of the saturated or the unsaturated cyclic moiety-containing dicarboxylic acids as described herein exhibits a friction coefficient in gasoline pursuant in to ASTM D6079 of about 0.35 or less (preferably, about 0.30 or less, and most preferably about 0.29 to about 0.20), and/or exhibit a mean wear scar in gasoline fuel of about 550 microns or less when measured pursuant to ASTM D 6079, or more preferably a mean wear scar of about 500 microns or less, more preferably 480 microns or less and/or exhibits about 60% or less rust in E0 to E10 gasoline when measured pursuant to ASTM D665A or B (preferably about 40% or less rust, more preferably 20% or less rust, even more preferably 10% or less rust, even more preferably 5% or less rust, or most preferably about 1% or less rust depending on the treat rate of the saturated or unsaturated cyclic moiety-containing dicarboxylic acid as shown in the Examples). Base gasoline fuel compositions not including the saturated or unsaturated cyclic moiety-containing dicarboxylic acid of the present disclosure, as shown in the Examples below, has 100% rust when evaluated pursuant to ASTM D665B.

As also shown by the Examples below, diesel fuel including such amounts of the saturated or the unsaturated cyclic moiety-containing dicarboxylic acids as described herein exhibit a friction coefficient in diesel pursuant in to ASTM D6079 of about 0.4 or less (and preferably about 0.35 or less, and most preferably about 0.2 to about 0.4 or about 0.30 to about 0.20) and/or exhibit about 25% or less rust in diesel when measured pursuant to NACE TM-0172-2001 using corrosive water per ASTM D1384 (preferably about 10% or less rust, more preferably about 6% or less rust, even more preferably about 5% or less rust or about 2% or less rust, or most preferably 1% or less rust) and/or exhibit a mean wear scar in diesel fuel of about 520 microns or less when measured pursuant to ASTM D 6079, or more preferably a mean wear scar of about 500 microns or less, more preferably 480 microns or less, even more preferably 460 microns or less, or about 440 microns or less, or about 420 microns or less.

Detergent

In another aspect, the fuel additives and fuels herein also include one or more detergent additives. While the type of detergent additive is not particularly limited, it preferably may include one or more of Mannich detergents, one or more succinimide detergents, one or more polyisobutylene amine detergents, one or more polyetheramine detergents, one or more quaternary ammonium salt detergents, or various combinations thereof. Suitable Mannich detergents include the reaction product(s) of a hydrocarbyl-substituted (or an alkyl-substituted) hydroxyaromatic or phenol compound, one or more aldehydes, and one or more amines as discussed more below. Suitable succinimide detergents include those prepared by reacting a hydrocarbyl-substituted succinic acylating agent with an amine, polyamine, or alkyl amine having one or more primary, secondary, or tertiary amino groups. Suitable quaternary ammonium detergent additives may be made by reacting a wide variety of amine, polyamine, or derivatives thereof having a tertiary amino group with a suitable quaternizing agent.

In yet other embodiments, other commercially available detergents may also be used as the detergent additives herein. Such detergents may also include bis-aminotriazole detergents as generally described in U.S. patent application Ser. No. 13/450,638, and a reaction product of a hydrocarbyl substituted dicarboxylic acid, or anhydride and an aminoguanidine, wherein the reaction product has less than one equivalent of amino triazole group per molecule as generally described in U.S. patent application Ser. Nos. 13/240,233 and 13/454,697.

In one approach or embodiment, a fuel additive or additive package (for either gasoline or diesel) may include about 20 to about 70 weight percent of detergent additives, in other approaches, about 30 to about 70 weight percent of detergent additives, or in yet further approaches, about 50 to about 70 weight percent of detergent additives (based on the total weight of the active detergent in the fuel additive). When blended into a fuel, the fuel compositions (gasoline and/or diesel) herein may include about 10 ppmw to about 300 ppmw of detergent additives, about 15 ppmw to about 200 ppmw, about 45 ppmw to about 160 ppmw, or about 55 ppmw to about 125 ppmw of detergent additives in the fuel composition (active detergent treat rates). In other more specific approaches, a gasoline fuel composition may include about 15 ppmw to about 300 ppmw of detergent additives, about 25 ppmw to about 200 ppmw, about 45 ppmw to about 160 ppmw, or about 55 ppmw to about 125 ppmw of detergent additives in a gasoline fuel composition (active detergent treat rates). In yet other more specific approaches, a diesel fuel composition may include 10 ppmw to about 200 ppmw of detergent additives, about 20 ppmw to about 150 ppmw, or about 30 ppmw to about 80 ppmw of detergent additives in a diesel fuel composition (active detergent treat rates).

In one approach or embodiment, suitable Mannich detergents, if used, include the reaction product(s) of a hydrocarbyl-substituted (or an alkyl-substituted) hydroxyaromatic or phenol compound, one or more aldehydes, and one or more amines. A suitable Mannich detergents for the fuel additives and fuels herein may have a structure of Formula II below:

(Formula II)

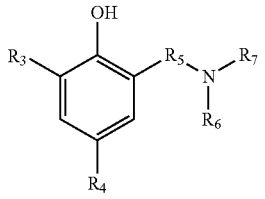

wherein one of $R_3$ and $R_4$ of Formula II is hydrogen or a C1 to C4 alkyl group, the other of $R_3$ and $R_4$ is a hydrocarbyl group having a number average molecular weight of about 500 to about 3000, $R_5$ of Formula II is a C1 to C4 alkylene or alkenyl linking group, and $R_6$ and $R_7$ of Formula II are, independently, hydrogen, a C1 to C12 alkyl group, or a mono or di(C1 to C4)alkyl amino C1-C12 alkyl group. In one aspect, $R_3$ of Formula II is hydrogen or a C1 to C4 alkyl group, $R_4$ of Formula II is a hydrocarbyl group having a number average molecular weight of about 500 to about 3000 (or about 500 to about 2100, or about 500 to about 1800, or about 500 to about 1500). In another aspect, $R_3$ of Formula II is hydrogen or a C1 to C4 alkyl group, and $R_3$ of Formula II is a polyisobutenyl group having a number average molecular weight of about 500 to about 1500.

In other approaches or embodiments, the detergent of the fuel additives and fuels herein may include at least two Mannich detergent additives. In this optional embodiment, a first Mannich detergent additive may have the structure of Formula II with $R_6$ and $R_7$ each being a C1 to C12 alkyl group (preferably a C3 to C6 alkyl group) and a second Mannich detergent additive may have the structure of Formula II with $R_6$ being hydrogen and $R_7$ being the di(C1 to C4)alkyl amino C1-C12 alkyl group. More specifically, the first Mannich detergent additive may have the structure of Formula IIa and the second Mannich detergent additive have the structure of Formula IIb:

(Formula IIa)

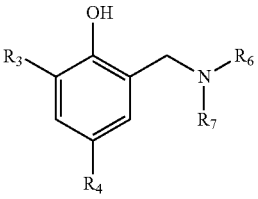

(Formula IIb)

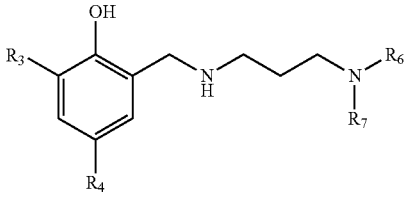

wherein each $R_3$ of Formula IIb is independently hydrogen or a C1 to C4 alkyl group, each $R_4$ is independently a hydrocarbyl group having a number average molecular weight of about 500 to about 3000 (or other ranges as discussed above), and $R_6$ and $R_7$ are, independently, a C1 to C12 alkyl group (preferably, a C1 to C6 alkyl group, or more preferably, a C1 to C4 alkyl group).

If the detergent includes the first and second Mannich detergent additives, then the detergent may include about 10 to about 30 weight percent of the first Mannich detergent additive and about 10 to about 30 weight percent of the second Mannich detergent additive. In other approaches and if the detergent includes the first and second Mannich detergent additives, then a weight ratio of the first Mannich detergent additive to the second Mannich detergent additive is about 1:1 to about 2:1.

In other approaches or embodiments, suitable succinimide detergents, if used, include those prepared by reacting a hydrocarbyl-substituted succinic acylating agent with an amine, polyamine, or alkyl amine having one or more primary, secondary, or tertiary amino groups. The succinimide can be made via the thermal ene reaction and/or halogenation-condensation as generally described in U.S. Pat. No. 7,897,696, which is incorporated herein by reference.

Suitable acylating agents may be an unsaturated substituted or un-substituted organic acid or anhydride, for example maleic or fumaric reactants of the general formula:

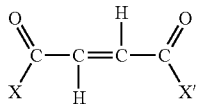

wherein X and X' are the same or different, provided that at least one of X and X' is a group that is capable of reacting to esterify alcohols, forming amides or amine salts with ammonia or amines, forming metal salts with reactive metals or basically reacting metal compounds, or otherwise functioning as an acylating agent. Typically, X and/or X' is —OH, —O-hydrocarbyl, —$NH_2$, and taken together X and X' can be —O— so as to form an anhydride. In some embodiments, X and X' are such that both carboxylic functions can enter into acylation reactions.

Maleic anhydride is a suitable acylating agent. Other suitable acylating agents include electron-deficient olefins such as monophenyl maleic anhydride; monomethyl maleic anhydride, dimethyl maleic anhydride, N-phenyl maleimide and other substituted maleimides; isomaleimides; fumaric acid, maleic acid, alkyl hydrogen maleates and fumarates, dialkyl fumarates and maleates, fumaronilic acids and maleanic acids; and maleonitrile and fumaronitrile.

Conversion of the hydrocarbyl-substituted succinic acylating agent to a succinimide is well-known in the art and may be accomplished through reacting the hydrocarbyl-substituted succinic acylating agent with a nitrogen source, such as ammonia, or an amine, such as a polyamine having at least one basic nitrogen. Conversion of an alkenyl succinic acid or anhydride into a succinimide is described, for instance, in U.S. Pat. Nos. 3,215,707 and/or 4,234,435, both of which are incorporated herein by reference. Suitable nitrogen sources include ammonia, monoamines, polyamines, polyalkylene polyamines, and mixtures thereof. The polyalkylene polyamines may include mixtures of polyethylene polyamines having an average of 5 nitrogen atoms, triethylene tetramine (TETA), tetraethylene pentamine (TEPA), or combinations thereof.

The amines used herein are well-known in the art and generally have at least one reactive N—H bond (nitrogen to hydrogen bond). The amine is optionally further substituted with other functional groups, such as a hydroxyl. In one embodiment, the amine contains one or more primary or secondary amino groups. The monoamine in one embodiment has 1 to 22 carbon atoms. Examples of a monoamine include butylamine, methylamine, dimethylamine, an alkanolamine containing one or more hydroxy groups such as ethanolamine, or mixtures thereof.

In some cases, the polyalkylene polyamines may have at least three nitrogen atoms and about 4 to 20 carbon atoms. One or more oxygen atoms may also be present in the polyamine. Several polyamines can be used in preparing the dispersant. In addition to the nitrogen sources mentioned above, non-limiting exemplary polyamines may include aminoguanidine bicarbonate (AGBC), ethylene diamine (EDA), N-methyl propylene diamine, diethylene triamine (DETA), pentaethylene hexamine (PEHA), or other heavy polyamines. Some heavy polyamines may comprise a mixture of polyalkylene polyamines having small amounts of lower polyamine oligomers such as TEPA and PEHA, having but primarily polyamine oligomers having seven or more nitrogen atoms, two or more primary amines per molecule, and more extensive branching than conventional polyamine mixtures. Additional non-limiting polyamines which may be used to prepare the dispersant are disclosed in U.S. Pat. No. 6,548,458, the disclosure of which is incorporated herein by reference in its entirety.

Other examples of suitable polyalkylene polyamines include, but are not limited to, propylene diamine, isopropylene diamine, butylene diamine, pentylene diamine, hexylene diamine, dipropylene triamine, dimethylaminopropyl amine, diisopropylene triamine, dibutylene triamine, di-sec-butylene triamine, tripropylene tetraamine, triisobutylene tetraamine, pentaethylene hexamine, and mixtures thereof. A particularly suitable group of polyalkylene polyamines may contain from about 2 to about 12 nitrogen atoms and from about 2 to about 24 carbon atoms. The alkylene groups of such polyalkylene polyamines may contain from about 2 to about 6 carbon atoms, more preferably from about 2 to about 4 carbon atoms.

In other approaches or embodiments, suitable quaternary ammonium salt detergents, if used, may be made by reacting a wide variety of amine, polyamine, or derivatives thereof having a tertiary amino group with a suitable quaternizing agent. For example, quaternary ammonium salt additives herein may be (i) a reaction product of a hydrocarbyl-substituted acylating agent and a compound having at least one oxygen or nitrogen atom capable of condensing with said acylating agent and further having a tertiary amino group and reacted with (ii) a quaternizing agent. In one approach, the amine with a tertiary amino group may be a wide variety of amine and polyamines having a tertiary amino group and capable of being quaternized so long as the resultant quaternary ammonium salts have the hydrocarbyl substituents and other characteristics as further described herein.

In one approach, the general amine or polyamine suitable for either the first or second quaternary ammonium salt herein may be a tertiary amine of the general formula (Formula III)

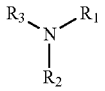

wherein each of $R_1$, $R_2$, and $R_3$ of Formula III above is selected from hydrocarbyl groups containing from 1 to 200 carbon atoms may be used. Each hydrocarbyl group $R_1$ to $R_3$ of Formula III may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, amido groups, ester groups, imido groups, and the like. Any of the foregoing hydrocarbyl groups may also contain hetero atoms, such as oxygen or nitrogen atoms. Particularly suitable hydrocarbyl groups may be linear or branched alkyl groups. Some representative examples of amine reactants which can be reacted to yield compounds of this invention are: trimethyl amine, triethyl amine, tri-n-propyl amine, dimethylethyl amine, dimethyl lauryl amine, dimethyl oleyl amine, dimethyl stearyl amine, dimethyl eicosyl amine, dimethyl octadecyl amine, N-methyl piperidine, N,N'-dimethyl piperazine, N-methyl-N-ethyl piperazine, N-methyl morpholine, N-ethyl morpholine, N-hydroxyethyl morpholine, pyridine, triethanol amine, triisopropanol amine, methyl diethanol amine, dimethyl ethanol amine, lauryl diisopropanol amine, stearyl diethanol amine, dioleyl ethanol amine, dimethyl isobutanol amine, methyl diisooctanol amine, dimethyl propenyl amine, dimethyl butenyl amine, dimethyl octenyl amine, ethyl didodecenyl amine, dibutyl eicosenyl amine, triethylene diamine, hexamethylene tetramine, N,N,N',N'-tetramethylethylenediamine, N,N,N',N'-tetramethylpropylenediamine, N,N,N',N'-tetraethyl-1,3-propanediamine, methyldi-cyclohexyl amine, 2,6-dimethylpyridine, dimethylcylohexylamine, $C_{10}$-$C_{30}$-alkyl or alkenyl-substituted amidopropyldimethylamine, $C_{12}$-$C_{200}$-alkyl or alkenyl-substituted succinic-carbonyldimethylamine, succinimide deriviatives thereof, and the like.

In other approaches, if the amine contains solely primary or secondary amino groups, it is necessary to alkylate at least one of the primary or secondary amino groups to a tertiary amino group prior to the reaction with the suitable quaternizing agent. In one embodiment, alkylation of primary amines and secondary amines or mixtures with tertiary amines may be exhaustively or partially alkylated to a tertiary amine. It may be necessary to properly account for the hydrogen on the nitrogen and provide base or acid as required (e.g., alkylation up to the tertiary amine requires removal (neutralization) of the hydrogen (proton) from the product of the alkylation). If alkylating agents, such as, alkyl halides or dialkyl sulfates are used, the product of alkylation of a primary or secondary amine is a protonated salt and needs a source of base to free the amine for further reaction.

Quaternizing agents for the detergents herein, in general, may also be a wide variety of compounds suitable for alkylating a tertiary amine. As discussed further below, suitable examples of quaternizing agents include, but are not limited to, dialkyl sulphates, esters of a carboxylic acids, alkyl halides, benzyl halides, hydrocarbyl substituted carbonates, hydrocarbyl epoxides in combination with an acid, or mixtures thereof. Other examples may include halides, hydroxides, sulphonates, bisulphites, alkyl sulphates, sulphones, phosphates, alkylphosphates, borates, alkylborates, nitrites, nitrates, carbonates, bicarbonates, alkanoates, alkyldithiophosphates, and the like quaternizing agent, and/or mixtures thereof.

In yet other approaches or embodiments, suitable polyetheramine detergents, if used, may be prepared as described, for example, in U.S. Pat. Nos. 4,288,612; 5,089,029; and/or U.S. Pat. No. 5,112,364; the disclosures of which are incorporated herein in their entireties. Polyetheramines suitable for use as the detergents herein are "single-molecule" additives, incorporating both amine and polyether functionalities within the same molecule. The polyether backbone can in one embodiment herein be based on propylene oxide, ethylene oxide, butylene oxide, or mixtures of these. In another embodiment, propylene oxide or butylene oxide or mixtures thereof are used to impart good fuel solubility. The polyetheramines can be monoamines, diamines or triamines. The molecular weight of the polyetheramines, in some embodiments, may range from 500 to 3000. In some embodiments, examples of commercially available polyetheramines are those under the tradename Jeffamines™ available from Huntsman Chemical Company Other suitable detergents for gasoline and/or diesel fuels may be used as needed for a particular application.

Alkoxylated Alcohol

In the context of gasoline fuel compositions, suitable fuel additives or gasoline fuels of the present disclosure may also include one or more optional alkoxylated alcohols. The alkoxylated alcohol is preferably a polyether prepared by reacting a long chain alkyl alcohol or alkylphenol with an alkylene oxide. By one approach, the alkoxylated alcohol may be one or more hydrocarbyl-terminated or hydrocarbyl-capped poly(oxyalkylene) polymers. The hydrocarbyl moieties thereof may be aryl or aliphatic groups, and preferably, aliphatic chains that are linear, branched or cyclic, and most preferably are linear aliphatic chains. In one approach, the alkoxylated alcohols may have the structure of Formula IVa, IVb, and/or IVc below:

(Formula IVa)

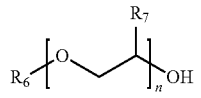

(Formula IVb)

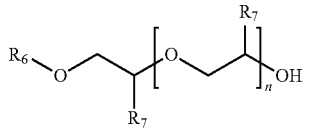

(Formula IVc)

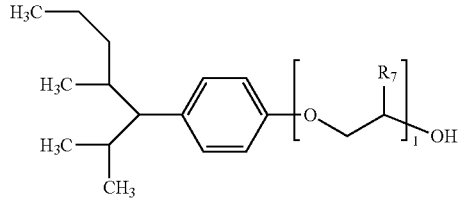

wherein $R_6$ of the Formula IV structures above is an aryl group or a linear, branched, or cyclic aliphatic group and preferably having 5 to 50 carbons (or 5 to 30 carbons) or may be a —$C_mH_{2m+1}$ group where m is an integer of 12 or more, $R_7$ of the Formula IV structures above is a C1 to C4 alkyl group, and n is an integer from 5 to 100 (or as further discussed below).

In some approaches, suitable alkoxylated alcohols are derived from lower alkylene oxides selected from the group consisting of ethylene oxide, propylene oxide, butylene oxide, copolymers thereof, and combinations thereof. Preferably, the lower alkylene oxides are propylene oxide or butylene oxide or copolymers of ethylene oxide, propylene oxide, and butylene oxide (as well as any combinations thereof). In another approach, the alkylene oxides are propylene oxide. Any copolymers of such alkylene oxides may be random or block copolymers. In one approach, the alkoxylated alcohols may be terminated or capped with an aryl, alkyl, or hydrocarbyl group and may include one or more aryl or linear, branched, or cyclic aliphatic C5 to C30 terminated alkoxylated alcohols, and in other approaches, a C16 to C18 (or blend thereof) terminated alkoxylated alcohol having 5 to 100, 10 to 80, 20 to 50, or 22 to 32 repeating units of the alkylene oxide therein (that is, n integer of the formula above). In some approaches, the alkoxylated alcohols may have a weight average molecular weight of about 1300 to about 2600 and, in other approaches, about 1600 to about 2200.

In some approaches, the aliphatic hydrocarbyl terminated alkoxylated alcohols may include about 20 to about 70 weight percent (in another approach, about 30 to about 50 weight percent) of an aliphatic C16 alkoxylated alcohol having 24 to 32 repeating units of alkoxylene oxide and/or may include about 80 to about 30 weight percent (in another approach, about 50 to about 70 weight percent) of an aliphatic C18 alkoxylated alcohol having 24 to 32 repeating units of alkoxylene oxide. In other approaches, the fuel additives herein, if including an alkoxylated alcohol, may also have about 8 percent or less (in other approaches, about 6 percent or less, and in yet other approaches, about 4 percent or less) of C20 or greater alkoxylated alcohols and/or about 4 weight percent or less (in or other approaches about 2 weight percent or less, and in yet other approaches, about 1 percent or less) of C14 or lower alkoxylated alcohols.

The aryl or hydrocarbyl-capped poly(oxyalkylene) alcohols may be produced by the addition of lower alkylene oxides, such as ethylene oxide, propylene oxide, or the butylene oxides, to a desired hydroxy compound R—OH (that is, a starter alcohol) under polymerization conditions, wherein R is the aryl or hydrocarbyl group having either 5 to 30 carbons or other chain length as noted above and which caps the poly(oxyalkylene) chain. The alkoxylated alcohols can be prepared by any starter alcohol that provides the desired polyol distribution. By one approach, the alkoxylated alcohol can be prepared by reacting a saturated linear or branched alcohol of the desired hydrocarbon size with the selected alkylene oxide and a double metal or basic catalyst. In one approach, the alkoxylated alcohol may be nonylphenol alkyxylated alcohol such as nonylphenol propoxylated alcohol.

In other approaches, in the polymerization reaction a single type of alkylene oxide may be employed, e.g., propylene oxide, in which case the product is a homopolymer, e.g., a poly(oxyalkylene) propanol. However, copolymers are equally satisfactory and random or block copolymers are readily prepared by contacting the hydroxyl-containing compound with a mixture of alkylene oxides, such as a mixture of ethylene, propylene, and/or butylene oxides. Random polymers are more easily prepared when the reactivities of the oxides are relatively equal. In certain cases, when ethylene oxides is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. In one example, a particular block copolymer may be represented by a polymer prepared by polymerizing propylene oxide on a suitable mono-hydroxy compound to form a poly(oxypropylene) alcohol and then polymerizing butylene oxide on the poly (oxyalkylene) alcohol.

A fuel additive for gasoline or a gasoline fuel herein, when included, may include about 5 to about 30 weight percent of the alkoxylated alcohol, about 8 to about 20 weight percent of the alkoxylated alcohol, or about 10 to about 15 weight percent of the alkoxylated alcohol (based on the active alkoxylated alcohol in the fuel additive). When blended into a gasoline fuel, the fuel may include about 2 ppmw to about 160 ppmw of the active alkoxylated alcohol, about 5 to about 150 ppmw, about 8 ppmw to about 50 ppmw, or about 15 ppmw to about 40 ppmw of the alkoxylated alcohol in the fuel. Generally, diesel fuels would not include the alkoxylated alkoxylated alcohols.

Lubricity Additives

In optional approaches or embodiments, the fuel additive or fuels herein (either gasoline or diesel) may also include one or more additional lubricity additives. When used, the additional lubricity additive may be selected from, for example, an ammonia succinimide, a linear or branched monocarboxylic acid or salt thereof, and/or mixtures thereof. If used, the fuel additives herein may include about 0 to about 20 weight percent of such additional lubricity additives (in other approaches, about 5 to about 15 weight percent of such additional lubricity additives, or about 8 to about 15 weight percent.) If used, fuel compositions (e.g., gasoline or diesel) herein may include about 0 ppmw to about 300 ppmw of the such additional lubricity additives (in other approaches, about 20 ppmw to about 250 ppmw, or about 40 ppmw to about 200 ppmw). While some compositions may include one or the other of the additional lubricity additives as needed, compositions herein may also include both with, in some embodiments, a weight ratio of the ammonia succinimide to the linear or branched monocarboxylic acid or salt thereof about 0.25:1 to about 2:1 or about 0.25:1 to about 1:1 in some embodiments if both additional lubricity additives are included in an additive or fuel composition.

In one approach or embodiment, suitable ammonia succinimides for the fuel additives and fuel compositions herein may be prepared by reacting a hydrocarbyl-substituted polycarboxylic acid compound with ammonia. In one approach, the hydrocarbyl-substituted polycarboxylic acid compound is a hydrocarbyl-substituted succinic acid or an anhydride thereof.

The succinimides or succinamides may be made by first reacting an olefinically unsaturated hydrocarbon of a desired molecular weight with maleic acid or maleic anhydride (or the like as discussed below) to form a hydrocarbyl-substituted succinic acid or anhydride. Reaction temperatures of about 100° C. to about 250° C. may be used. This reaction is often promoted by the addition of chlorine. Alkenyl succinimides or succinamides in which the succinic group contains a hydrocarbyl substituent containing at least 4 carbon atoms may be useful in the present disclosure and are described for example in U.S. Pat. Nos. 3,172,892; 3,202,678; 3,216,936; 3,219,666; 3,254,025; 3,272,746; 4,234,435; 4,613,341; and 5,575,823, the disclosures of all of which are hereby incorporated by reference.

The hydrocarbyl substituent may include olefins such as, but are not limited to, cracked wax olefins, linear alpha olefins, branched chain alpha olefins, polymers and copolymers of lower olefins. The olefins can be chosen from ethylene, propylene, butylene, such as isobutylene, 1-octane, 1-hexene, 1-decene and the like. Some useful polymers and/or copolymers of lower olefins include, but are not limited to, polypropylene, polybutenes, polyisobutene, ethylene-propylene copolymers, ethylene-isobutylene copolymers, propylene-isobutylene copolymers, ethylene-1-decene copolymers and the like. Hydrocarbyl substituents have also been made from olefin terpolymers. Useful products can be made from ethylene-$C_{3-12}$ alpha olefin-$C_{5-12}$ non-conjugated diene terpolymers; such as ethylene-propylene-1,4-hexadiene terpolymer; ethylenepropylene-1,5-cyclooctadiene terpolymer; ethylene-propylenenorbornene terpolymers and the like.

In one approach or embodiment, the hydrocarbyl substituents may be derived from butene polymers, for example polymers of isobutylene. Suitable polyisobutenes for use in preparing the polycarboxylic acids or anhydrides of the present disclosure can in some embodiments include those polyisobutenes that comprise at least about 20% of the more reactive methylvinylidene isomer, for example at least 50%, and as a further example at least 70%. Suitable polyisobutenes include those prepared using BF3 catalysts. The preparation of such polyisobutenes in which the methylvinylidene isomer comprises a high percentage of the total composition is described in U.S. Pat. Nos. 4,152,499 and 4,605,808, the disclosures of which are hereby incorporated by reference.

The number average molecular weight of the hydrocarbyl substituent may be about 100 to about 2500, for example from about 150 to about 1500, and in other approaches, about 600 to about 1000, as determined by gel permeation chromatography (GPC) using polystyrene as a calibration reference. In yet other approaches, the number average molecular weight of the hydrocarbyl substituent may range from at least about 100, at least about 150, at least about 600, or at least about 900 and no more than about 2500, no more than about 1500, or no more than about 1000. Thus, in some approaches, hydrocarbyl groups of predominantly $C_4$-$C_{36}$ are useful herein with $C_{14}$-$C_{18}$ hydrocarbyl groups being suitable in other approaches. In other approaches, the hydrocarbyl group ranges from at least 4 carbons, at least 6 carbons, at least 8 carbons, at least 10 carbons, at least 12 carbons, at least 14 carbons, or at least 16 carbons and at most 40 carbons, at most 36 carbons, at most 30 carbons, at most 24 carbons, or at most 20 carbons.

Carboxylic reactants, as noted above, may preferably be maleic acid or maleic anhydride, but carboxylic reactants other than maleic acid or maleic anhydride can also be employed in some approaches to form the polycarboxylic acid or anhydrides herein. Suitable reactants may also include, but not be limited to, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

The hydrocarbyl-substituted succinic anhydrides or acids may be prepared by the thermal reaction of a polyolefin and maleic anhydride, as described, for example in U.S. Pat. Nos. 3,361,673 and 3,676,089, the disclosures of which are incorporated by reference. Alternatively, the substituted succinic anhydrides can be prepared by the reaction of chlorinated polyolefins with maleic anhydride, as described, for example, in U.S. Pat. No. 3,172,892, the disclosure of which is also incorporated by reference. A further discussion of hydrocarbyl-substituted succinic anhydrides can be found, for example, in U.S. Pat. Nos. 4,234,435; 5,620,486 and 5,393,309, the disclosures of which are incorporated by reference.

The reaction between the hydrocarbyl-substituted polycarboxylic acid or anhydride and the ammonia to form the neutral lubricity additive can, in one embodiment, be carried out by mixing the components and heating the mixture to a temperature high enough to cause a reaction to occur but not so high as to cause decomposition of the reactants or products or the anhydride may be heated to reaction temperature and the ammonia added over an extended period. A useful temperature is about 100° C. to about 250° C. Exemplary results can be obtained by conducting the reaction at a temperature high enough to distill out water formed in the reaction.

In yet other approaches and if used, the fuel additives and fuels herein may also include a linear monoacidic lubricity additive or salt thereof. In some approaches or embodiments, the linear monoacidic additive is a linear monocarboxylic acid, a linear fatty acid, blends thereof, and/or salts thereof. In other approaches or embodiments, the linear monocarboxylic acid or linear fatty acid blend includes linear carbon chain(s) having 6 to 40 carbon atoms, typically 8 to 24 carbon atoms, and in other approaches, about 12 to about 20 carbon atoms. In yet further approaches, the linear monocarboxylic acid or the linear fatty acid blend includes linear carbon chain(s) with a number of carbon atoms ranging from at least 6, at least 8, or at least 12 and at most 40, at most 24, or at most 20. The acids, often saturated, can also contain one or more carbon-carbon double bonds, and the acids can be of natural origin, synthetic origin, or combinations thereof.

The hydrocarbyl radicals (preferably alkyl radicals) of the monocarboxylic acids or fatty acids are linear, saturated or unsaturated, carbon chains of preferably only straight chains with carbon and hydrogen. However, the acids may include optional substituents such as for example hydroxyl, hydrogen, amino or nitro groups, provided any substitution does not impair the predominant hydrocarbon character of the linear carbon chain.

In some approaches or embodiments, useful linear monocarboxylic acids, or linear fatty acids, include for example lauric acid, tridecanoic acid, myristic acid, pentadecanoic acid, palmitic acid, margaric acid, stearic acid, arachidic acid, behenic acid, oleic acid, erucic acid, palmitoleic acid, myristoleic acid, linoleic acid, linolenic acid, elaeosteric acid and arachidonic acid, ricinoleic acid and also fatty acid mixtures obtained from natural fats and oils, for example coconut oil fatty acid, peanut oil fatty acid, linseed oil fatty acid, palm oil fatty acid, rapeseed oil fatty acid, castor oil fatty acid, colza oil fatty acid, soybean oil fatty acid, sunflower oil fatty acid, and tall oil fatty acid (TOFA), salts thereof, or mixtures thereof. In some approaches or embodiments, the linear monocarboxylic acid, fatty acid, or blend includes or is oleic acid, TOFA, lauric acid, salts thereof, or mixtures thereof.

Fuel Additive:

When formulating the fuel compositions of this application, the above described additives (including at least the detergent, the optional alkoxylated alcohol (i.e., used in some embodiments of gasoline), and the multi-functional cyclic alkyl dicarboxylic acid) may be employed in amounts sufficient to improve at least friction and/or corrosion as shown in the Examples below. The fuel additives and fuel compositions herein may also include other optional additives as needed for a particular application (or fuel type) and may include, as needed, one or more of a demulsifier, other corrosion inhibitor(s), an antiwear additive, an antioxidant, a metal deactivator, an antistatic additive, a dehazer, an antiknock additive, a lubricity additive, and/or a combustion improver.

In some approaches or embodiments, the fuel additive or additive package herein (suitable for either diesel or gasoline) may include about 20 to about 70 weight percent of the one or more detergent additives (preferably, about 25 to about 60 weight percent, and most preferably, about 30 to about 45 weight percent of detergent additives); about 0 to about 30 weight percent of the alkoxylated alcohol (preferably, about 10 to about 30 weight percent, more preferably about 10 to about 20 weight percent, and most preferably about 12 to about 18 weight percent of the alkoxylated alcohol); about 1 to about 20 weight percent of the saturated or unsaturated cyclic moiety-containing dicarboxylic acid (preferably, about 5 to about 18 weight percent, and most preferably, about 8 to about 15 weight percent the saturated or unsaturated cyclic moiety-containing dicarboxylic acid); and about 0 to about 20 weight percent of other lubricity additives (such as ammonia succinimides and/or TOFA) (preferably, about 1 to about 30 weight percent, and most preferably, about 5 to about 20 weight percent of other lubricity additives). Other ranges of the detergent additives, the optional alkoxylated alcohol, the saturated or unsaturated cyclic moiety-containing dicarboxylic acid, or the other lubricity additives may also be used in the fuel additive, the additive package, or the fuel as described above in this disclosure and/or as needed for a particular application.

In other approaches, a fuel composition (e.g., either gasoline or diesel) may include about 15 to about 300 ppmw of the detergent (preferably, about 45 to about 250 ppmw, and most preferably, about 80 to about 200 ppmw detergent additives); about 0 to about 160 ppmw of the alkoxylated alcohol (preferably, about 5 to about 150 ppmw of the alkoxylated alcohol, more preferably, about 20 to about 100 ppmw, and most preferably, about 20 to about 80 ppmw of the alkoxylated alcohol); about 5 to about 250 ppmw of the saturated or unsaturated cyclic moiety-containing dicarboxylic acid (preferably, about 20 to about 250 ppmw, and most preferably, about 40 to about 150 ppmw the saturated or unsaturated cyclic moiety-containing dicarboxylic acid); and about 0 to about 300 ppmw of other lubricity additives (preferably, about 20 to about 250 ppmw, and most preferably, about 40 to about 200 ppmw of other lubricity additives). It will also be appreciated that any endpoint between the above described ranges are also suitable range amounts as needed for a particular application. The above-described amounts reflects additives on an active ingredient basis, which means the additives noted above excludes the weight of (i) unreacted components associated with and remaining in the product as produced and used, and (ii) solvent(s), if any, used in the manufacture of the product either during or after its formation.

In more specific approaches, a gasoline fuel additive or gasoline additive package herein may include about 20 to about 60 weight percent of the one or more detergent additives (preferably, about 25 to about 50 weight percent, and most preferably, about 30 to about 45 weight percent detergent additives); about 8 to about 30 weight percent of the alkoxylated alcohol (preferably, about 10 to about 25 weight percent, more preferably about 12 to about 20 weight percent, and most preferably about 12 to about 18 weight percent of alkoxylated alcohol); about 1 to about 30 weight percent of the saturated or unsaturated cyclic moiety-containing dicarboxylic acid (preferably, about 5 to about 20 weight percent, and most preferably, about 10 to about 15 weight percent the saturated or unsaturated cyclic moiety-containing dicarboxylic acid); and about 1 to about 20 weight percent of other lubricity additives (such as ammonia succinimide or TOFA) (preferably, about 2 to about 15 weight percent, and most preferably, about 3 to about 10 weight percent of the other lubricity additives).

In other more specific approaches, a gasoline fuel composition may include about 15 to about 300 ppmw of the detergent (preferably, about 45 to about 250 ppmw, and most preferably, about 80 to about 180 ppmw of detergent additives); about 0 to about 160 ppmw of the alkoxylated alcohol (preferably, about 5 to about 150 ppmw of the alkoxylated alcohol, more preferably, about 20 to about 100 ppmw, and most preferably, about 20 to about 80 ppmw of the alkoxylated alcohol); about 5 to about 250 ppmw of the saturated or unsaturated cyclic moiety-containing dicarboxylic acid (preferably, about 20 to about 250 ppmw, and most preferably, about 40 to about 150 ppmw of the saturated or unsaturated cyclic moiety-containing dicarboxylic acid); and about 5 to about 300 ppmw of other lubricity additives (preferably, about 20 to about 250 ppmw, and most preferably, about 40 to about 200 ppmw of other lubricity additives). It will also be appreciated that any endpoint between the above described ranges are also suitable range amounts as needed for a particular application. The above-described amounts reflects additives on an active ingredient basis, which means the additives noted above excludes the weight of (i) unreacted components associated with and remaining in the product as produced and used, and (ii) solvent(s), if any, used in the manufacture of the product either during or after its formation.

In yet other more specific approaches, a diesel fuel additive or diesel additive package herein may include about 3 to about 50 weight percent of the one or more detergent additives (preferably, about 5 to about 45 weight percent, and most preferably, about 5 to about 20 weight percent of detergent additives); about 1 to about 20 weight percent of the saturated or unsaturated cyclic moiety-containing dicarboxylic acid (preferably, about 2 to about 15 weight percent, and most preferably, about 5 to about 15 weight percent of the saturated or unsaturated cyclic moiety-containing dicarboxylic acid); and about 0 to about 30 weight percent of other lubricity additives (such as ammonia succinimide or TOFA) (preferably, about 2 to about 20 weight percent, and most preferably, about 5 to about 15 weight percent of other lubricity additives).

In further more specific approaches, a diesel fuel composition may include about 10 to about 200 ppmw of the detergent (preferably, about 20 to about 150 ppmw, and most preferably, about 30 to about 80 ppmw of detergent additives); about 10 to about 250 ppmw of the saturated or unsaturated cyclic moiety-containing dicarboxylic acid (preferably, about 20 to about 200 ppmw, and most preferably, about 40 to about 125 ppmw of the saturated or unsaturated cyclic moiety-containing dicarboxylic acid); and about 0 to about 300 ppmw of the other lubricity additives (preferably, about 20 to about 250 ppmw, and most preferably, about 40 to about 200 ppmw of other lubricity additives). It will also be appreciated that any endpoint between the above described ranges are also suitable range amounts as needed for a particular application. The above-described amounts reflects additives on an active ingredient basis, which means the additives noted above excludes the weight of (i) unreacted components associated with and remaining in the product as produced and used, and (ii) solvent(s), if any, used in the manufacture of the product either during or after its formation.

In other approaches, the fuel additive package or any fuel herein (e.g., gasoline and/or diesel) may also include a certain weight ratio of the total detergent additives to the saturated or unsaturated cyclic alkyldicarbocylic additive. For instance, the fuel additives or the fuels herein may have a weight ratio of the total detergent additives to the saturated or unsaturated cyclic alkyldicarboxylic additive of about 10.0 or less (i.e., about 10:1 or less), about 9 or less (i.e., 9:1 or less), about 8 or less, about 7 or less, about 6 or less, or about 5 or less, or about 4 or less and, in other approaches, about 3 or more (i.e., 3:1 or more), about 4 or more, about 5 or more, about 6 or more, or about 7 or more.

Other Additives

One or more optional compounds may be present in the fuel additives or fuels of the disclosed embodiments herein as needed for a particular application and/or fuel type. For example, the fuel additive or fuels may contain conventional quantities of cetane improvers, octane improvers, corrosion inhibitors, cold flow improvers (CFPP additive), pour point depressants, solvents, demulsifiers, lubricity additives, friction modifiers, amine stabilizers, combustion improvers, detergents, dispersants, antioxidants, heat stabilizers, conductivity improvers, metal deactivators, marker dyes, organic nitrate ignition accelerators, cyclomatic manganese tricarbonyl compounds, carrier fluids, and the like. In some aspects, the compositions described herein may contain about 10 weight percent or less, or in other aspects, about 5 weight percent or less, based on the total weight of the additive concentrate, of one or more of the above optional additives. Similarly, the fuels may contain suitable amounts of conventional fuel blending components such as methanol, ethanol, dialkyl ethers, 2-ethylhexanol, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. Nos. 5,575,823 and 3,015,668 both of which disclosures are herein incorporated by reference in their entirety.

The additives of the present application and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

Fuels

The fuels of the present application may be applicable to the operation of diesel, jet, or gasoline engines, and preferably, spark-ignition or gasoline engines or compression ignition or diesel engines. The engines may include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all middle distillate fuels, diesel fuels, biorenewable fuels, biodiesel fuel, fatty acid alkyl ester, gas-to-liquid (GTL) fuels, gasoline, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. Preferably, the additives herein are used in spark-ignition fuels or gasoline and/or compression-ignition or diesel fuels as discussed above. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol. Preferred fuels include diesel fuels.

Accordingly, aspects of the present application are directed to compositions effective for, methods related to, and/or the use of the above noted fuel additive package and/or fuels including the fuel additive package for providing friction reduction (e.g., a reduced friction coefficient pursuant to ASTM D6079 as described herein) and/or providing corrosion reduction (e.g., a reduced amount of rust when measured pursuant to ASTM D665A, ASTM D665B, and/or NACE TM-0172-2001 as described herein). In some approaches, for example, the fuel additives are configured to achieve a reduced friction coefficient in gasoline pursuant to ASTM D6079 (modified to use 25 ml of gasoline at 25° C.) of about 0.35 or less, about 0.32 or less, about 0.30 or less, or about 0.28 or less. In other approaches, the fuel additives are configured to achieve a mean wear scar in gasoline pursuant to ASTM D6079 of about 600 microns or less, about 580 microns or less, about 560 microns or less, or in other approaches, a mean wear scar of about 400 microns to about 600 microns (or other ranges within the endpoints noted above).

In other approaches, the fuel additives are configured to achieve a reduced friction coefficient in diesel pursuant to ASTM D6079 of about 0.38 or less, about 0.35 or less, about 0.30 or less, or about 0.28 or less. In other approaches, the fuel additive are configured to achieve a mean wear scar in diesel pursuant to ASTM D6079 of about 550 microns or less, about 520 microns or less, about 460 microns or less, or in other approaches, a mean wear scar of about 550 microns to about 400 microns (or other ranges within the endpoints noted above).

In yet other approaches, the fuel additives and fuels herein are configured to achieve a reduced level of corrosion as measured pursuant to ASTM D665B or D665B with about 60 percent or less rust in E0 to E10 gasoline, about 50 percent or less rust, about 40 percent or less rust, about 30 percent or less rust, about 20 percent or less rust, about 15 percent or less rust in E0 to E10 gasoline, about 10 percent or less rust, about 5 percent or less rust, about 2 percent or less rust, or about 1 percent or less rust in E0 to E10 gasoline. In further approaches, the fuel additives and fuels herein are configured to achieve a reduced level of corrosion in diesel as measured pursuant to NACE TM-0172-2001 using corrosive water prepared per ASTM D1384 with 15 weight percent or less rust in diesel, about 10 percent or less rust, about 5 percent or less rust, about 2 percent or less rust, or about 1 percent or less rust in diesel.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition. All percent numbers herein, unless specified otherwise, is weight percent.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, molecular weight is determined by gel permeation chromatography (GPC) using commercially available polystyrene standards (with a Mp of about 162 to about 14,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 0.38 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

As used herein and unless the context suggests otherwise, a major amount refers to greater than 50 weight percent (greater than 60 weight percent, greater than 70 weight percent, greater than 80 weight percent or greater than 90 weight percent), and a minor amount refers to less than 50 weight percent (less than 40 weight percent, less than 30 weight percent, less than 20 weight percent, or less than 10 weight percent).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

EXAMPLES

The following examples are illustrative of exemplary embodiments of the disclosure. In these examples as well as elsewhere in this application, all ratios, parts, and percentages are by weight unless otherwise indicated. It is intended that these examples are being presented for the purpose of illustration only and are not intended to limit the scope of the invention disclosed herein. Any reference to a standardized test method, unless apparent from the context of its use in the specification, claims, or these Examples, refers to the version of the test method publically available at the time of this disclosure. The specifications for Base Fuels A, B, and C used in the Examples are below in Table 1 with Base Fuels A and B being gasoline and Base Fuel C being diesel.

TABLE 1

Fuel Specifications.

| FUEL PROPERTY | BASE FUEL A (E10 Gasoline) | BASE FUEL B (E0 Gasoline) | Base Fuel C (Diesel) |
|---|---|---|---|
| API Gravity | 60.3 | 58.7 | 37.4 |
| Specific Gravity | 0.7377 | 0.7440 | 0.8378 |
| Density | 0.7370 | 0.7432 | 0.8369 |
| % Benzene | 0.47 | n.a. | n.a |
| Bromine No. | 9.7 | n.a. | n.a. |
| BTU Gross (btu/lb) | 18711 | 19674 | 19704 |
| BTU Net (btu/lb) | 17477 | 18465 | 18481 |
| Unwashed Gum (ASTM D-381) | 3 | 1.5 | n.a |

TABLE 1-continued

Fuel Specifications.

| FUEL PROPERTY | BASE FUEL A (E10 Gasoline) | BASE FUEL B (E0 Gasoline) | Base Fuel C (Diesel) |
|---|---|---|---|
| Washed Gum (ASTM D-381) | <0.5 | <0.5 | n.a |
| ASTM D-525 Oxidation (minutes) | 960 | 960+ | n.a |
| RVP (ASTM D-5191) | 9.46 | 8.8 | n.a |
| % Carbon | 82.63 | n.a. | 86.59 |
| % Hydrogen | 13.53 | n.a. | 13.41 |
| Aromatics (vol-%) | 27.9 | 30.7 | 23.9 |
| Olefins (vol-%) | 4.7 | 9.2 | 1.3 |
| Saturates (vol-%) | 67.4 | 60.1 | 74.8 |
| Ethanol (vol-%) | 9.3 | n.a. | 0 |
| Oxygen Content | 3.84 | 0 | 0 |
| Sulfur (ppm) | 8.4 | 4.6 | 6.5 |
| RON | 98.2 | 91.4 | n.a |
| MON | 87.5 | 83.3 | n.a |
| Octane (R + M)/2 | 92.85 | 87.35 | n.a. |
| Initial Boiling Point | 87 | 91.3 | 331.4 |
| 5% | 99.9 | 113.7 | 373.7 |
| 10% | 110.5 | 125 | 394.3 |
| 20% | 125.2 | 140.2 | 421.8 |
| 30% | 140.3 | 157.1 | 447.7 |
| 40% | 152.5 | 174.2 | 472.6 |
| 50% | 165.6 | 193.3 | 495.8 |
| 60% | 228.4 | 227.1 | 520.1 |
| 70% | 250.5 | 257.8 | 547.4 |
| 80% | 276 | 288.5 | 578.0 |
| 90% | 316 | 332.6 | 417.2 |
| 95% | 343.6 | 368.4 | 649.4 |
| End Point | 398.5 | 423.8 | 668.3 |
| % Recovery | 96.1 | 97.2 | 98.21 |
| Residue | 1.1 | 1.1 | 1.0 |
| Loss | 2.8 | 1.7 | 0.8 |

Example 1

Inventive and Comparative fuel additive packages of Table 2 below were prepared for evaluation of friction performance in E10 gasoline (e.g., Base Fuel A). The Detergents for this Example included: Detergent 1 prepared from a high reactivity polyisobutylene cresol, dibutylamine, and formaldehyde according to known methods (see, e.g., U.S. Pat. No. 6,800,103, which is incorporated herein by reference); Detergent 2 was prepared from a high reactivity polyisobutylene cresol, dimethylamino propyl amine, and formaldehyde according to known methods (see, e.g., U.S. Pat. No. 6,800,103); and Detergent 3 was a succinimde detergent prepared as generally described in U.S. Pat. No. 7,897,696. The propoxylated alcohol was a blend of commercially available C16-C18 propoxylated alcohols. TOFA was an additional lubricity additive including Tall Oil Fatty Acid. Ammonia succinimide was an additional lubricity additive prepared as described in US 2020/0040274, which is incorporated herein by reference. The unsaturated cyclic moiety-containing dicarboxylic acid was prepared from acrylic acid and linoleic acid as described in U.S. Pat. No. 3,753,968, which is incorporated herein by reference.

TABLE 2

| | Treat Rate, PTB | | | | | | |
|---|---|---|---|---|---|---|---|
| | C1 | C2 | C3 | C 4 | Inventive 1 | Inventive 2 | Invention 3 |
| Detergent 1 | 16.8 | 16.8 | 16.8 | 16.8 | 16.8 | 16.8 | 16.8 |
| Detergent 2 | 16.8 | 16.8 | 16.8 | 16.8 | 16.8 | 16.8 | 16.8 |
| Detergent 3 | 2.7 | 2.7 | 2.7 | 2.7 | 2.7 | 2.73 | 2.73 |
| Propoxylated alcohol | 16.1 | 16.1 | 16.1 | 16.1 | 16.1 | 16.1 | 16.1 |
| TOFA | — | 5 | 5 | 10 | — | — | — |
| Ammonia succinimide | — | — | 5 | 2.5 | — | 5 | 2.5 |
| Unsaturated Cyclic Alkyl-dicarboxylic acid | — | — | — | — | 5 | 5 | 10 |
| Detergent to cyclic moiety-containing dicarboxylic acid Acid Ratio | — | — | — | — | 7.3 | 7.3 | 3.6 |

Each of the Comparative and Inventive additives of Table 2 above were blended into E10 gasoline Base Fuel A. The base fuel with no additives as well as the inventive and comparison fuels were then evaluated for mean wear scar and friction coefficient pursuant to ASTM D6079 (except using 25° C. and 25 ml sample volume). Results are provided in Table 3 below and shows that the gasoline fuels including the cyclic moiety-containing dicarboxylic acid of the present disclosure was effective as a friction modifier that reduces mean wear scar as well as friction coefficient.

TABLE 3

| | Base Fuel A | C1 | C2 | C3 | C4 | Inventive 1 | Inventive 2 | Inventive 3 |
|---|---|---|---|---|---|---|---|---|
| Mean wear scar, um | 800 | 816 | 536 | 497 | 453 | 534 | 547 | 466 |
| Friction Coefficient | 0.603 | 0.567 | 0.398 | 0.378 | 0.529 | 0.299 | 0.286 | 0.302 |

Example 2

Inventive and Comparative fuel additive packages of Table 4 below were prepared for evaluation of corrosion inhibition pursuant to ASTM D665A and/or D665B. The same fuel additives of Example 1 were used in the additive packages of Table 4 for this Example.

TABLE 4

| | Treat Rate, PTB | | | | | | |
|---|---|---|---|---|---|---|---|
| | Inventive 4 | Inventive 5 | Inventive 6 | Inventive 7 | Inventive 8 | Inventive 9 | C5 |
| Detergent 1 | 1.68 | 2.36 | 4.72 | 7.08 | 9.44 | 16.8 | 28.1 |
| Detergent 2 | 1.68 | 2.36 | 4.72 | 7.08 | 9.44 | 16.8 | 4.7 |

TABLE 4-continued

| | Treat Rate, PTB | | | | | | |
|---|---|---|---|---|---|---|---|
| | Inventive 4 | Inventive 5 | Inventive 6 | Inventive 7 | Inventive 8 | Inventive 9 | C5 |
| Detergent 3 | 0.27 | 0.54 | 1.08 | 1.62 | 2.16 | 2.7 | 1.4 |
| Ammonia Succinimide | — | — | — | — | — | — | 4 |
| Propoxylated alcohol | 1.61 | 3.2 | 6.4 | 9.6 | 12.8 | 16.1 | 22.1 |
| Cyclic moiety-containing dicarboxylic acid | 1 | 2 | 4 | 6 | 8 | 10 | 0 |
| Dodecyl-succinic acid | — | — | — | — | — | — | 1 |

Each of the additives of Table 4 above were blended into either gasoline Base Fuel A (E10) or Base Gasoline Fuel B (E0). The Base Fuels with no additives and the inventive and comparison fuels were then evaluated for percent rust pursuant to ASTM D665B and/or ASTM D665A. Results are provided in Table 5 below and shows that the fuels including the alkyl dicarboxylic acid of the present disclosure were also effective as a corrosion inhibitor that minimized or prevented the formulation of rust in E0 to E10 gasoline fuels as compared to the untreated base fuels.

TABLE 5

| | Base Fuel A or B | Inventive 4 | Inventive 5 | Inventive 6 | Inventive 7 | Inventive 8 | Inventive 9 | C5 |
|---|---|---|---|---|---|---|---|---|
| Rust % (E0 Fuel), ASTM D665A | 100 | 59.8 | 45.8 | 23.1 | 14.6 | 2.1 | 0 | — |
| Rust % (E10 Fuel), ASTM D665B | 100 | 16.3 | 0.36 | 0.03 | 0.01 | 0 | 0 | 73.8 |
| Rust % (E10 Fuel), ASTM D665A | 90 | — | — | — | — | — | 0 | — |

As shown in Table 5 above, inventive fuel compositions provided improved rust protection from base fuels without the additives herein and shows even low treat rates of the saturated or unsaturated cyclic moiety-containing dicarboxylic acid additive can provide corrosion protection relative to base fuels without the cyclic moiety-containing dicarboxylic acid additive. That is, improving from 100% rust in untreated base fuels to 60% or lower rust in treated fuels depending on the treat rate of the cyclic alkyldicarboxylic acid. In some embodiments, treat rates of the saturated or unsaturated cyclic moiety-containing dicarboxylic acid additive will be used to achieve rust levels, in some approaches, of about 10% or less, 5% or less, 2% or less, or 1% or less.

Example 3

Inventive and Comparative fuel additive packages of Table 6 below were prepared for evaluation of friction performance and corrosion inhibition in diesel fuel (Base Fuel C). The same fuel additives of Example 1 were used in the additive packages of Table 6 for this Example in diesel fuel.

TABLE 6

| | Treat Rate, PTB | | | |
|---|---|---|---|---|
| | C6 | C7 | Inventive 10 | Inventive 11 |
| TOFA | 10.8 | 25.2 | — | — |
| Alkyl-dicarboxylic acid | — | — | 10.8 | 25.2 |

Each of the additives of Table 6 above were blended into diesel Base Fuel C. The base diesel fuel C with no additives and the inventive and comparison fuels was then evaluated for friction performance pursuant to ASTM D6079 and also percent rust pursuant to NACE TM-0172-2001 (modified using corrosive water prepared by ASTM D1384). Results are provided in Table 7 below and show that the diesel fuels including the cyclic moiety-containing dicarboxylic acid of the present disclosure were effective as a corrosion inhibitor and minimized or prevented the amount of rust in diesel fuels.

TABLE 7

| | Base fuel | C6 | C7 | Inventive 10 | Inventive 11 |
|---|---|---|---|---|---|
| Mean wear scar, um | 616 | 565 | 466 | 539 | 463 |
| Friction coefficient | 0.49 | 0.367 | 0.229 | 0.389 | 0.261 |
| Rust (%), NACE TM-0172-2001 | 92.1 | 81.1 | 59.0 | 6.2 | 1.3 |

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A fuel additive package comprising:

a detergent including one or more Mannic detergent additives having the structure of Formula II:

(Formula II)

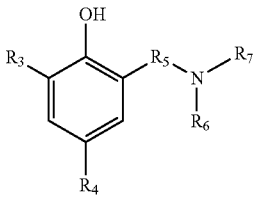

wherein $R_3$ of Formula II is hydrogen or a C1 to C4 alkyl group, $R_4$ of Formula II is a hydrocarbyl group having a molecular weight of about 500 to about 3000, $R_5$ of Formula II is a C1 to C4 alkylene or alkenyl group, and $R_6$ and $R_7$ of Formula II are, independently, hydrogen, a C1 to C12 alkyl group, or a C1 to C4 alkyl amino di(C1-C12 alkyl) group;

a multi-functional additive comprising a cyclic moiety-containing dicarboxylic acid; and optionally, an alkoxylated alcohol.

2. The fuel additive package of claim 1, wherein the cyclic moiety-containing dicarboxylic acid is a compound having the structure of Formula I:

(Formula I)

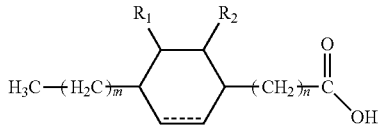

wherein one of $R_1$ and $R_2$ of Formula I is hydrogen and the other of $R_1$ and $R_2$ is —COOH; and m and n are, independently, integers from 1 to 11 and where the sum of m+n is 10 to 20.

3. The fuel additive package of claim 2, wherein m and n are each, independently, integers from 5 to 9 and the sum of m+n is 10 to 14.

4. The fuel additive package of claim 1, wherein the fuel additive package includes about 1 to about 20 weight percent of the cyclic moiety-containing dicarboxylic acid.

5. The fuel additive package of claim 4, wherein the fuel additive package further includes about 20 to about 70 weight percent of the detergent.

6. The fuel additive of claim 1, wherein the detergent includes two Mannich detergent additives, wherein the first Mannich detergent additive has the structure of Formula I with $R_6$ and $R_7$ each being the C1 to C12 alkyl group and the second Mannich detergent additive has the structure of Formula I with $R_6$ being hydrogen and $R_7$ being the di(C1 to C4)alkyl amino C1-C12 alkyl group.

7. The fuel additive package of claim 5, further comprising a succinimide detergent prepared by reacting a hydrocarbyl-substituted succinic acylating agent with an amine, polyamine, or alkyl amine having one or more primary, secondary, or tertiary amino groups.

8. The fuel additive package of claim 5, comprising about 5 to about 30 weight percent of the alkoxylated alcohol.

9. The fuel additive package of claim 1, wherein the alkoxylated alcohol is a polyether prepared by reacting an alkyl alcohol or an alkylphenol with an alkylene oxide selected from ethylene oxide, propylene oxide, butylene oxide, copolymers thereof, or combinations thereof.

10. The fuel additive package of claim 1, wherein the alkoxylated alcohol is a polyether having the structure of Formula III:

(Formula III)

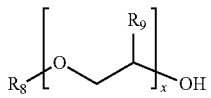

wherein $R_8$ of Formula III is an aryl group or a linear, branched, or cyclic aliphatic group having 5 to 50 carbons, $R_9$ of Formula III is a C1 to C4 alkyl group, and x is an integer from 5 to 100.

11. The fuel additive package of claim 1, further comprising about 1 to about 20 weight percent of a lubricity additive.

12. The fuel additive package of claim 1, further comprising a lubricity additive and wherein the lubricity additive is selected from an ammonia succinimide prepared by reacting a hydrocarbyl-substituted succinic anhydride with ammonia, a linear or branched monocarboxylic acid or salt thereof, or mixtures thereof.

13. A fuel composition comprising:

a major amount of a diesel fuel or a gasoline fuel;

about 15 to about 300 ppmw of a detergent including one or more Mannich detergent additives having the structure of Formula II:

(Formula II)

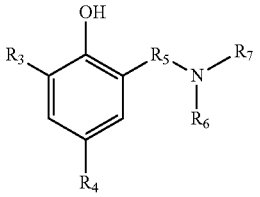

wherein $R_3$ of Formula II is hydrogen or a C1 to C4 alkyl group, $R_4$ of Formula II is a hydrocarbyl group having a molecular weight of about 500 to about 3000, $R_5$ of Formula II is a C1 to C4 alkylene or alkenyl group, and $R_6$ and $R_7$ of Formula II are, independently, hydrogen, a C1 to C12 alkyl group, or a C1 to C4 alkyl amino di(C1-C12 alkyl) group;

about 0 to about 150 ppmw of an alkoxylated alcohol; and about 5 to about 250 ppmw of a multi-functional additive provided by a cyclic moiety-containing dicarboxylic acid.

14. The fuel composition of claim 13, wherein the cyclic moiety-containing dicarboxylic acid is a compound having the structure of Formula I:

(Formula I)

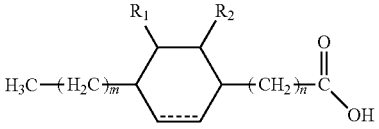

wherein one of $R_1$ and $R_2$ of Formula I is hydrogen and the other of $R_1$ and $R_2$ is —COOH; and m and n are, independently, integers from 1 to 11 and where the sum of m+n is 10 to 20.

15. A method of reducing wear and corrosion in a combustion engine, the method comprising:

operating the combustion engine on a fuel composition containing a major amount of a fuel and a minor amount of the fuel additive package of claim 1;

wherein the fuel additive package in the fuel exhibits a friction coefficient pursuant to ASTM D6079 of about 0.4 or less and exhibits about 10% or less rust when measured pursuant to ASTM D665A, ASTM D66B, or NACE TM-0172-2001.

16. The method of claim 15, wherein the fuel is gasoline or diesel.

17. The method of claim 15, wherein the fuel includes about 50 to about 300 ppmw of the detergent;

about 0 to about 150 ppmw of the alkoxylated alcohol; and about 5 to about 250 ppmw of the unsaturated cyclic moiety-containing dicarboxylic acid.

18. The method of claim 15, wherein the cyclic moiety-containing dicarboxylic acid is a compound having the structure of Formula I:

(Formula I)

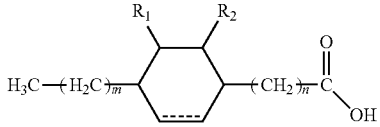

wherein one of $R_1$ and $R_2$ of Formula I is hydrogen and the other of $R_1$ and $R_2$ is —COOH; and m and n are, independently, integers from 1 to 11 and where the sum of m+n is 10 to 20.

19. The method of claim 15, wherein the detergent includes the Mannich detergent and a succinimide detergent.

* * * * *